United States Patent [19]

Nachbur et al.

[11] Patent Number: 4,536,779

[45] Date of Patent: Aug. 20, 1985

[54] HEAT-SENSITIVE RECORDING MATERIAL

[75] Inventors: Hermann Nachbur, Reinach; Christel Tempel, Riehen, both of Switzerland

[73] Assignee: Ciba-Geigy Corporation, Ardsley, N.Y.

[21] Appl. No.: 557,013

[22] Filed: Dec. 1, 1983

[30] Foreign Application Priority Data

Dec. 10, 1982 [CH] Switzerland ..... 7215/82

[51] Int. Cl.[3] ..... B41M 5/18; B41M 5/22

[52] U.S. Cl. ..... 346/212; 346/216; 346/225; 427/150; 427/151

[58] Field of Search ..... 346/212, 216, 217, 225, 427/150, 151

[56] References Cited

U.S. PATENT DOCUMENTS

| | | | |
|---|---|---|---|
| 3,244,549 | 4/1966 | Farnham et al. | 346/221 |
| 3,244,550 | 4/1966 | Farnham et al. | 346/221 |
| 3,451,338 | 6/1969 | Baum | 346/218 |
| 3,834,929 | 9/1974 | Hayashi et al. | 346/211 |
| 3,937,864 | 2/1976 | Kohmura et al. | 427/150 |
| 4,312,522 | 1/1982 | Yamaguchi et al. | 427/150 |
| 4,446,209 | 5/1984 | Iwakura et al. | 346/216 |
| 4,453,744 | 6/1984 | Würmli et al. | 346/216 |

OTHER PUBLICATIONS

Fieser & Fieser, Advanced Organic Chemistry, Reinhold Publishing Corp. New York, 1961 pp. 743–744.

*Primary Examiner*—Bruce H. Hess
*Attorney, Agent, or Firm*—Edward McC. Roberts; Kevin T. Mansfield

[57] ABSTRACT

A heat-sensitive recording material which comprises in its color reactant system, as developer for the color former, at least one aluminum or zinc salt of a phenolsulfonyl compound of the formula

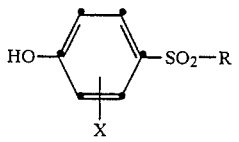

(1)

wherein

R is $C_1$–$C_{12}$alkyl, cycloalkyl, phenyl, benzyl, or phenyl which is substituted by halogen, lower alkyl, lower alkoxy, nitro or methylenedioxy, and X is hydrogen, halogen, lower alkyl or lower alkoxy.

10 Claims, No Drawings

HEAT-SENSITIVE RECORDING MATERIAL

The present invention relates to a heat-sensitive recording material which contains in its color reactant system, as developer for the color former, at least one aluminum salts, or preferably at least one zinc salts, of a phenolsulfonyl compound of the formula

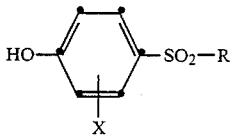

(1)

wherein

R is alkyl of 1 to 12, preferably 1 to 4, carbon atoms, cycloalkyl, phenyl, benzyl, or phenyl which is substituted by halogen, lower alkyl, lower alkoxy, nitro or methylenedioxy; and X is hydrogen, halogen, lower alkyl or lower alkoxy.

The substituents R and X, which occur two or three times both in the zinc and aluminum phenates, may be identical or different. The substituents are preferably identical.

Lower alkyl and lower alkoxy normally denote groups which contain 1 to 5, preferably 1 to 3, carbon atoms. Examples of lower alkyl groups are methyl, ethyl, isopropyl, sec-butyl or tert-butyl; and examples of lower alkoxy groups are methoxy, ethoxy, isopropoxy, n-butoxy or tert-butoxy.

X is preferably halogen, methyl, methoxy, ethoxy or, most preferably, hydrogen.

An alkyl group R may be straight chain or branched. Examples of such alkyl groups are methyl, ethyl, n-propyl, isopropyl, n-butyl, isobutyl, sec-butyl, hexyl, octyl, isooctyl, nonyl, isononyl or dodecyl.

R as cycloalkyl is e.g. cyclopentyl or, preferably, cyclohexyl.

Preferred substituents in the phenyl moiety of the radical R are chlorine, methyl or methoxy. R is preferably phenyl or phenyl substituted by halogen, methyl, methoxy or ethoxy, e.g. chlorophenyl, methylphenyl, dimethylphenyl or methoxyphenyl.

Halogen is e.g. fluorine, bromine or, preferably, chlorine.

Preferred phenolsulfonyl compounds of the formula (1) are those in which R is methylphenyl, methoxyphenyl or preferably phenyl, and X is hydrogen.

The aluminum and zinc salt of the phenolsulfonyl compounds of the formula (1) constitute a novel class of developers or electron acceptors for color formers.

The zinc salt are prepared by reacting 2 moles of a phenolsulfonyl compound of the formula (1) with 1 mole of the zinc salt of an inorganic acid or of a lower aliphatic or aromatic carboxylic acid. The zinc salt so obtained have the formula

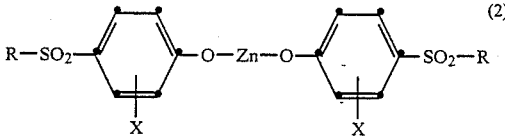

(2)

wherein R and X have the given meanings. The substituents defined for R and X may be identical or different.

The reaction is preferably carried out in a melt or in an alkaline solution of the phenolsulfonyl compound employed, conveniently in the temperature range from 60° to 90° C. and preferably in the presence of an alkali, e.g. a hydroxide, carbonate or bicarbonate of an alkali metal, or ammonium hydroxide, ammonium carbonate or ammonium bicarbonate.

Typical representative of the phenolsulfonyl compounds employed in the above reaction are:

4-hydroxy-1-methylsulfonylbenzene,
4-hydroxy-1-ethylsulfonylbenzene,
4-hydroxy-1-cyclohexylsulfonylbenzene,
4-hydroxy-1-benzylsulfonylbenzene,
4-hydroxydiphenylsulfone,
4'-nitro-4-hydroxydiphenylsulfone,
2'-nitro-4-hydroxydiphenylsulfone,
4'-chloro-4-hydroxydiphenylsulfone,
4'-fluoro-4-hydroxydiphenylsulfone,
4'-methyl-4-hydroxydiphenylsulfone,
3',4'-dimethyl-4-hydroxydiphenylsulfone,
4'-methoxy-4-hydroxydiphenylsulfone or
4'-n-butoxy-4-hydroxydiphenylsulfone.

The most preferred phenolsulfonyl compounds are 4-hydroxydiphenylsulfone and 4'-methyl-4-hydroxydiphenylsulfone.

Typical examples of inorganic zinc salts are zinc chloride, zinc sulfate or zinc nitrate. Examples of organic zinc salts are zinc diacetate, zinc oxalate, zinc hydrogen benzoate or, preferably, zinc dibenzoate.

Instead of the above zinc salts, it is also possible to use zinc oxide or zinc carbonate, in which case the reaction with the phenolsulfonyl compound is preferably carried out in the presence of ammonium formate.

The aluminum salts are obtained by condensation of 3 moles of a phenolsulfonyl compound of the formula (1), or an alkali metal salt thereof, with a water-soluble aluminum salt of an inorganic or organic acid.

The preferred procedure comprises reacting 3 moles of a phenolsulfonyl of the formula (1) with the aluminum salt of a lower aliphatic or cycloaliphatic alcohol, preferably a secondary aliphatic or cycloaliphatic alcohol, most preferably with aluminum triisopropylate, aluminum sec-butyrate or aluminum cyclohexylate. The aluminum phenates so obtained have the formula

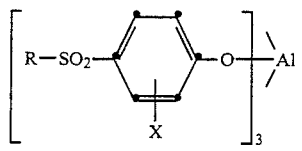

(3)

wherein R and X have the given meanings.

The reaction is conveniently carried out by heating the reactants in the temperature range from 80° to 200° C. and distilling off the lower aliphatic or cycloaliphatic alcohol set free.

Phenolsulfonyl compounds of the formula (1) and the preparation thereof are described e.g. in Beilstein, E II 6, pp. 852–855 and E III 6, pp. 4445–55.

A preferred process for the preparation of the phenolsulfonyl compounds of the formula (1) comprises reacting a compound of the formula

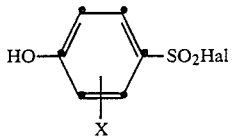

(4)

with a compound RH, or reacting a compound of the formula $$R—SO_2—Hal \quad (5)$$

with a phenol compound of the formula

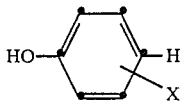

(6)

in which formulae (4), (5) and (6) above X and R have the given meanings and Hal is halogen, e.g. chlorine, bromine or chlorine. The reaction is carried out in anhydrous medium and in the presence of a Lewis acid, e.g. $AlCl_3$, $FeCl_3$, $ZnCl_2$, $SnCl_4$, $SbCl_5$or $BF_3$, and advantageously in the temperature range from 50° to 200° C., most preferably from 80° to 130° C. A further process comprises heating a compound of the formula

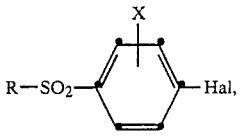

(7)

wherein R, X and Hal have the given meanings, with aqueous potassium hydroxide solution to 200°–220° C.

The aluminum and zinc salts of the phenolsulfonyl compounds of the formula (1) are virtually colorless and odorless and are very reactive with conventional color formers, so that spontaneous stable and non-fading copies are obtained.

In particular, the copies obtained with the aluminum and zinc salts employed in the practice of this invention have excellent stability at temperatures of up to 60° C.

The color formers suitable for use in the recording or copying material of this invention are known colorless or faintly colored chromogenic compounds which, on coming into contact with the zinc salts of the formula (2) or with the aluminum salts of the formula (3), become colored or change color. It is possible to use color formers, or mixtures thereof, which belong to e.g. the classes of the azomethines, fluorances, benzofluoranes, phthalides, azaphthalides, spiropyranes, spirodipyranes, leucoauramines, triarylmethaneleuco dyes, carbazolylmethanes, chromenoindoles, chromenopyrazoles, phenoxazines, phenothiazines, as well as chromeno or chromano color formers.

Examples of such suitable color formers are: crystal violet lactone (Registered Trademark), 3,3-(bisaminophenyl)-phthalides, 3,3-(bis-substituted indolyl)-phthalides, 3-(aminophenyl)-3-indolylphthalides, 3-(aminophenyl)-3-indolylazaphthalides, 6-dialkylamino-2-n-octylaminofluoranes, 6-dialkylamino-2-arylaminofluoranes, 6-dialkylamino-3-methyl-2-arylaminofluoranes, 6-dialkylamino-2- or -3-lower alkylfluoranes, 6-dialkylamino-2-dibenzylaminofluoranes, 6-N-cyclohexyl-N-lower alkyl-3-methyl-2-arylaminofluoranes, 6-pyrrolidino-2-arylaminofluoranes, bis-(aminophenyl)-furyl-, -phenyl- or -carbazolylmethanes, 3'-phenyl-7-dialkylamino-2,2'-spirodibenzopyranes, bis-dialkylaminobenzhydrol-alkyl- or -arylsulfinates, benzoylidialkylaminophenothiazines or benzoyldialkylaminophenoxazines.

Aluminum and zinc salts of the phenolsulfonyl compounds of the formula (1) are suitable for use as color developers in a heat-sensitive or thermoreactive recording material. This recording material usually contains at least one carrier, one color former, one developer and optionally also a binder and/or wax. Thermoreactive recording systems comprise, for example, heat-sensitive recording and copying materials and papers. These systems are used e.g. for recording information, for example in electronic computers, teleprinters or telewriters, or in recording and measuring instruments, e.g. electrocardiographs. The image (mark) formation can also be effected manually with a heated pen. Laser beams can also be used to produce heat-induced marks.

The thermoreactive recording material can be composed such that the color former is dispersed or dissolved in one binder layer and the developer is dissolved or dispersed in the binder in a second layer. Another possibility consists in dispersing both the color former and the developer in one layer. By means of heat the binder is softened at specific areas and the color former comes into contact with the developer at those points where heat is applied and the desired color develops at once. The aluminum and zinc salts of the phenolsulfonyl compounds of formula (1) may be used in heat-sensitive recording materials by themselves, as mixtures, or in admixture with known developers.

Typical examples of known developers are activated clays such as attapulgite, acid clay, bentonite, montmorillonite, activated clay, e.g. acid-activated bentonite or montmorillonite, and also zeolith, halloysite, silica, alumina, aluminium sulfate, aluminium phosphate, zinc chloride, zinc nitrate, kaolin or any clay or acidic organic compound, for example unsubstituted or ring-substituted salicylic acid or salicylates and their metal salts, or an acidic polymer, for example a phenolic polymer, an alkylphenolacetylene resin, a maleic acid/rosin resin or a partially or completely hydrolysed polymer of maleic acid and styrene, ethylene or vinyl methyl ether, or carboxypolymethylene.

The aluminum and zinc salts employed in the practice of this invention can also be used with advantage in combination with metal-free compounds, for example 4-tert-butylphenol, 4-phenylphenol, 4-hydroxydiphenylether, α-naphthol, β-naphthol, 4-hydroxymethylbenzoate, 4-hydroxyethylbenzoate, 4-hydroxy-n-butylbenzoate or, preferably, 4-hydroxybenzylbenzoate, 4-hydroxyacetophenone, 2,2'-dihydroxydiphenyl, 4,4-isopropylidenediphenol, 4,4'-isopropylidene-bis(2-methylphenol), 4,4'-bis(hydroxyphenyl)-valeric acid, hydroquinone, pyrogallol, phloroglucinol, p-, m- and o-hydroxybenzoic acid, gallic acid, 1-hydroxy-2-naphthoic acid, as well as boric acid and organic, preferably aliphatic, dicarboxylic acids, for example tartaric acid, oxalic acid, maleic acid, citric acid, citraconic acid and succinic acid.

It is preferred to use fusible, film-forming binders for the production of the thermoreactive recording material. These binders are normally water-soluble, whereas the color formers and the developers are insoluble in water. The binder should be able to disperse and fix the color former and the developer at room temperature.

By applying heat the binder softens or melts, so that the color former comes in contact with the developer and a color is able to form. Examples of binders which are soluble, or at least swellable, in water are hydrophillic polymers, such as polyvinyl alcohol, polyacrylic acid, hydroxyethyl cellulose, methyl cellulose, carboxymethyl cellulose, polyacrylamide, polyvinyl pyrrolidone, gelatin, starch or etherified corn starch.

If the color former and the developer are in two separate layers, it is possible to use water-insoluble binders, i.e. binders which are soluble in non-polar or only weakly polar solvents, for example natural rubber, synthetic rubber, chlorinated rubber, alkyd resins, polystyrene, styrene/butadiene copolymers, and polymethylacrylates, ethyl cellulose, nitrocellulose and polyvinyl carbazole. The preferred arrangement, however, is that in which the color former and the developer are contained in one layer in a water-soluble binder.

The thermoreactive coatings may contain further ingredients. To improve the degree of whiteness, to facilitate the printing of papers, and to prevent the heated pen from sticking, the coatings may contain e.g. talcum, $TiO_2$, ZnO, $CaCO_3$ (e.g. chalk), clays, such as kaolin or also organic pigments, for example urea/formaldehyde polymers or melamine/formaldehyde polymers. In order to effect the color formation only within a limited temperature range, there may be added substances such as urea, thiourea, diphenyl thiourea, acetamide, acetanilide, stearyl amide, phthalic anhydride, metal chlorides, metal stearates, e.g. zinc stearate, phthalonitrile or other appropriate fusible products which induce the simultaneous melting of the color former and the developer. Thermographic recording materials preferably contain waxes, e.g. carnauba wax, montan wax, paraffin wax, polyethylene wax, or condensates of higher fatty acids and ethylenediamine.

The invention is illustrated by the following Examples, in which parts and percentages are by weight, unless otherwise indicated.

Preparatory Examples

EXAMPLE A

With stirring, 23.4 g of 4-hydroxydiphenylsulfone are heated to 145° C. To the resultant melt is added in portions over 50 minutes a mixture of 15.4 g of zinc dibenzoate and 7.9 g of ammonium bicarbonate. The reaction mixture is then stirred for 3½ hours at 150° C., after which time no further evolution of carbon dioxide is observed. The warm melt is poured into a porcelain dish and allowed to cool. The solid is comminuted and suspended in 200 g of deionized water using a mixer. The suspension is filtered and the filter cake is washed with deionized water and dried in vacuo at 60° C., affording 25 g of a pale beige-colored crude product which constitutes the zinc salt of the formula

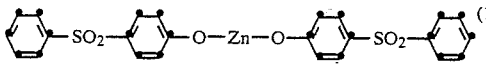

(11)

The crude product has a melting point of 160°–225° C.

Elemental analysis: 9.6% S 8.46% Zn.

EXAMPLE B

With stirring, 35.2 g of 4-hydroxydiphenylsulfone and 10.4 g of aluminum triisopropylate are heated to 150° C. The isopropanol set free is distilled off over 30 minutes, the last traces being removed by a vacuum treatment under 22 mbar. The residual melt is poured into a porcelain dish and allowed to cool. The cold solid is pulverised, affording 34.6 g (95% of theory) of a pale beige-colored product which constitutes the aluminum triphenate of the formula

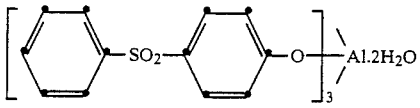

(12)

which melts at 115°–118° C.

Elemental analysis: calc. C=56.7%, H=4.05%, Al=3.54%, S=12.6%. found C=56.4%, H=4.35%, Al=3.61%, S=12.1%.

EXAMPLE C 11.7 g of 4-hydroxydiphenylsulfone are stirred into a solution of 2 g of sodium hydroxide in 150 ml of water over 5 minutes at 70° C. Then a solution of 7.19 g of $ZnSO_4.7H_2O$ (zinc sulfate.7 hydrate) in 50 ml of water are added dropwise to the colorless solution at the same temperature over 15 minutes. The resultant suspension is cooled to 20° C. and filtered, and the filter residue is washed and dried in vacuo at 80° C., affording 13.6 g of a white product which corresponds to the zinc salt of the formula (11). This product melts at >250° C.

Elemental analysis: 11.7% S, 12.2% Zn.

EXAMPLE D 10.75 g of 4-hydroxy-4'-chlorodiphenylsulfone are stirred into 40 ml of an aqueous solution of 1N sodium hydroxide and 150 ml of water over 5 minutes at 70° C. Then a solution of 5.75 g of $ZnSO_4.7H_2O$ in 40 ml of water is added dropwise over 15 minutes. The suspension so obtained is filtered, affording 12 g of a white substance of the formula

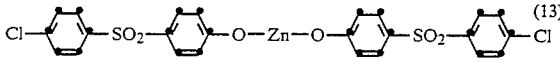

(13)

with a melting point of >250° C.

Elemental analysis: 11% C, 10.4% S, 10.8% Zn.

EXAMPLE E 9.92 g of 4-hydroxy-4'-methyldiphenylsulfone are stirred into 40 ml of an aqueous solution of 1N sodium hydroxide and 150 ml of water over 5 minutes at 70° C. Then a solution of 5.75 g of $ZnSO_4.7H_2O$ in 40 ml of water is added dropwise. The suspension so obtained is filtered, affording 11.3 g of a light brown substance of the formula

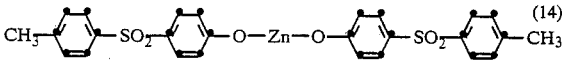

(14)

This zinc salt has a melting point of >250° C.

Elemental analysis: 10.9% S, 11.4% Zn.

EXAMPLE F 10.5 g of 4-hydroxy-3',4'-dimethyldiphenylsulfone are stirred into 40 ml of an aqueous solution of 1N sodium hydroxide and 150 ml of water over 5 minutes at 70° C. Then a solution of 5.8 g of $ZnSO_4.7H_2O$ in 40 ml of water is added dropwise over 15 minutes. The suspension so obtained is filtered, affording 11.9 g of a pale beige-colored substance of the formula

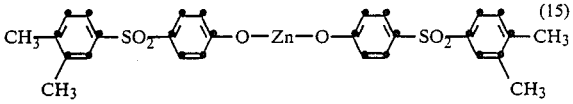

(15)

with a melting point of >250° C.

Elemental analysis: 10.4% S, 10.5% Zn.

EXAMPLE G

With stirring, 12.4 g of 4-hydroxy-4'-methyldiphenylsulfone and 3.5 g of aluminum triisopropylate are heated to 80° C. and then isopropyl alcohol is slowly distilled off. After 40 minutes the residual isopropanol is removed under reduced pressure (23 mbar). The residue is poured warm into a mortar, cooled and pulverised. Yield: 13.8 g of a crude product which is the aluminum triphenate of the formula

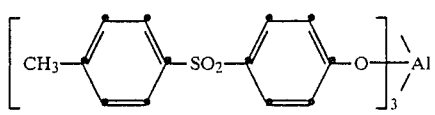

(16)

which melts at 131°-133° C.

Elemental analysis: 3.1% Al, 10.3% S.

EXAMPLE 1

Two dispersions A and B are first prepared

Dispersion A is prepared by grinding 8 g of the zinc salt of 4-hydroxydiphenylsulfone prepared in Example A, 32 g of a 10% aqueous solution of polyvinyl alcohol 25/140, and 20 g of water, in a ball mill to a particle size of 2-4 μm.

Dispersion B is prepared by grinding 1 g of crystal violet lactone, 4 g of a 10% aqueous solution of polyvinyl alcohol 25/140, and 2 g of water, in a ball mill to a particle size of 2-4 μm.

The two dispersions are then mixed.

The colorless mixture is coated with a doctor blade on paper having a weight of 50 g/m². The coating weight of the mixture is 3 g/m² (dry weight). The thermographic recording paper so obtained has a colorless surface. A blue color develops rapidly at 80° C., with saturation being reached at about 150° C.

When this colored sample, which has developed at 150° C., is stored for 1 hour at 58° C., virtually no decrease in color is visible. Intense lightfast and stable blue colors can also be obtained by using any of the other color developers prepared according to Examples B to G.

EXAMPLE 2

Two dispersions A and B are first prepared

Dispersion A is prepared by grinding 8 g of the aluminum salt of 4-hydroxydiphenylsulfone obtained in Example B, 32 g of a 10% aqueous solution of polyvinyl alcohol 25/140, and 20 g of water in a ball mill to a particle size of 2-4 μm.

Dispersion B is prepared by grinding 1 g of 2-phenylamino-3-methyl-6-N-cyclohexyl-N-methylaminofluorane, 4 g of a 10% aqueous solution of polyvinyl alcohol 25/140, and 1.5 g of water, in a ball mill to a particle size of 2-4 μm.

The two dispersions are then mixed.

The colorless mixture is coated with a doctor blade on paper having a weight of 50 g/m². The coating weight of the mixture is 3 g/m² (dry weight). The thermographic recording paper so obtained has colorless surface. A black color develops rapidly at 80° C., with saturation being reached at 175°-200° C.

An intense stable black color can also be obtained by using any of the other color developers prepared according to Examples A and C to G.

What is claimed is:

1. A heat-sensitive recording material which comprises in its color reactant system, as developer for the color former, at least one aluminum or zinc salt of a phenolsulfonyl compound of the formula

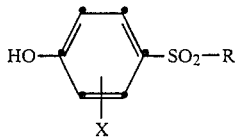

(1)

wherein

R is $C_1$-$C_{12}$alkyl, cycloalkyl, phenyl, benzyl, or phenyl which is substituted by halogen, lower alkyl, lower alkoxy, nitro or methylenedioxy, and X is hydrogen, halogen, lower alkyl or lower alkoxy.

2. A recording material of claim 1, wherein the developer is the aluminum or zinc salt of a phenolsulfonyl compound of the formula (1), wherein X is hydrogen, halogen, methyl, methoxy or ethoxy.

3. A recording material of claim 1, wherein the developer is the aluminum or zinc salt of a phenolsulfonyl compound of the formula (1), wherein R is phenyl or phenyl substituted by halogen, methyl, methoxy or ethoxy.

4. A recording material of claim 1, wherein the developer is the zinc salt of 4-hydroxydiphenylsulfone.

5. A recording material of claim 1, wherein the developer is the zinc salt of 4-hydroxy-4'-methyldiphenylsulfone.

6. A recording material of claim 1, wherein the developer is the aluminum salt of 4-hydroxydiphenylsulfone.

7. A recording material of claim 1, wherein the developer is the aluminum salt of 4-hydroxy-4'-methyldiphenylsulfone.

8. A recording material of claim 1, which comprises a base sheet, at least one color former, at least one developer and at least one binder in at least one recording layer, wherein the developer is the aluminum or zinc salt of the phenolsulfonyl compound of the formula (1).

9. A recording material of claim 8, wherein the developer is the zinc salt of 4-hydroxydiphenylsulfone or 4-hydroxy-4'-methyldiphenylsulfone.

10. A recording material of claim 8, wherein the developer is the aluminum salt of 4-hydroxydiphenylsulfone or 4-hydroxy-4'-methyldiphenylsulfone.

* * * * *